US009089162B2

(12) United States Patent
Mishra et al.

(10) Patent No.: US 9,089,162 B2
(45) Date of Patent: Jul. 28, 2015

(54) SMOKING ARTICLES CONTAINING POLYMERS OF POLYCARBOXYLIC ACID ESTERS

(75) Inventors: Munmaya K. Mishra, Manakin Sabot, VA (US); Kathryne E. Paine, Midlothian, VA (US); John B. Paine, III, Midlothian, VA (US); Shengsheng Liu, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 1041 days.

(21) Appl. No.: 13/071,751

(22) Filed: Mar. 25, 2011

(65) Prior Publication Data

US 2012/0042887 A1 Feb. 23, 2012

Related U.S. Application Data

(60) Provisional application No. 61/318,205, filed on Mar. 26, 2010.

(51) Int. Cl.
*A24B 15/28* (2006.01)
*A24D 1/02* (2006.01)

(52) U.S. Cl.
CPC ..... *A24D 1/02* (2013.01); *A24B 15/282* (2013.01); *A24B 15/284* (2013.01)

(58) Field of Classification Search
None
See application file for complete search history.

(56) References Cited

U.S. PATENT DOCUMENTS 3,111,127 A 11/1963 Jarboe
3,470,883 A 10/1969 Shepherd et al.
3,603,319 A 9/1971 Badgett et al.
4,002,179 A 1/1977 Rundberg, Jr. et al.
4,092,988 A 6/1978 Van Auken et al.
4,119,106 A 10/1978 Grubbs et al.
4,177,339 A 12/1979 Van Auken et al.
4,212,310 A 7/1980 Van Auken et al.
4,286,604 A 9/1981 Ehretsmann et al.
4,385,073 A 5/1983 Pittet et al.
4,966,171 A 10/1990 Serrano et al.

(Continued)

FOREIGN PATENT DOCUMENTS

CA 700009 A 12/1964
GB 1 255 564 12/1971
WO WO 96/22960 8/1996

OTHER PUBLICATIONS

International Preliminary Report on Patentability Issued Oct. 2, 2012 for PCT/IB2011/001167.

(Continued)

*Primary Examiner* — Michael J Felton
(74) *Attorney, Agent, or Firm* — Buchanan Ingersoll & Rooney PC

(57) ABSTRACT

Disclosed is a smoking article containing a rod containing a smokable composition, an optional wrapper for the rod, and at least one polymer or oligomer comprising monomer units of a polycarboxylic acid ester disposed on or in the rod, the wrapper, or both. The polycarboxylic acid ester contains an acid moiety having at least two carboxylic groups, and at least two alcohol moieties independently selected from those corresponding to a cycloalkyl alcohol or an aryl alcohol. The cycloalkyl alcohol or aryl alcohol is a flavorant, or chemesthetic agent, or both. In addition, a method for the controlled release of these flavorant or chemesthetic agents is described, which comprises pyrolyzing at least one polymer or oligomer.

17 Claims, 1 Drawing Sheet

(56) References Cited

U.S. PATENT DOCUMENTS

Figures 1A, 1B:
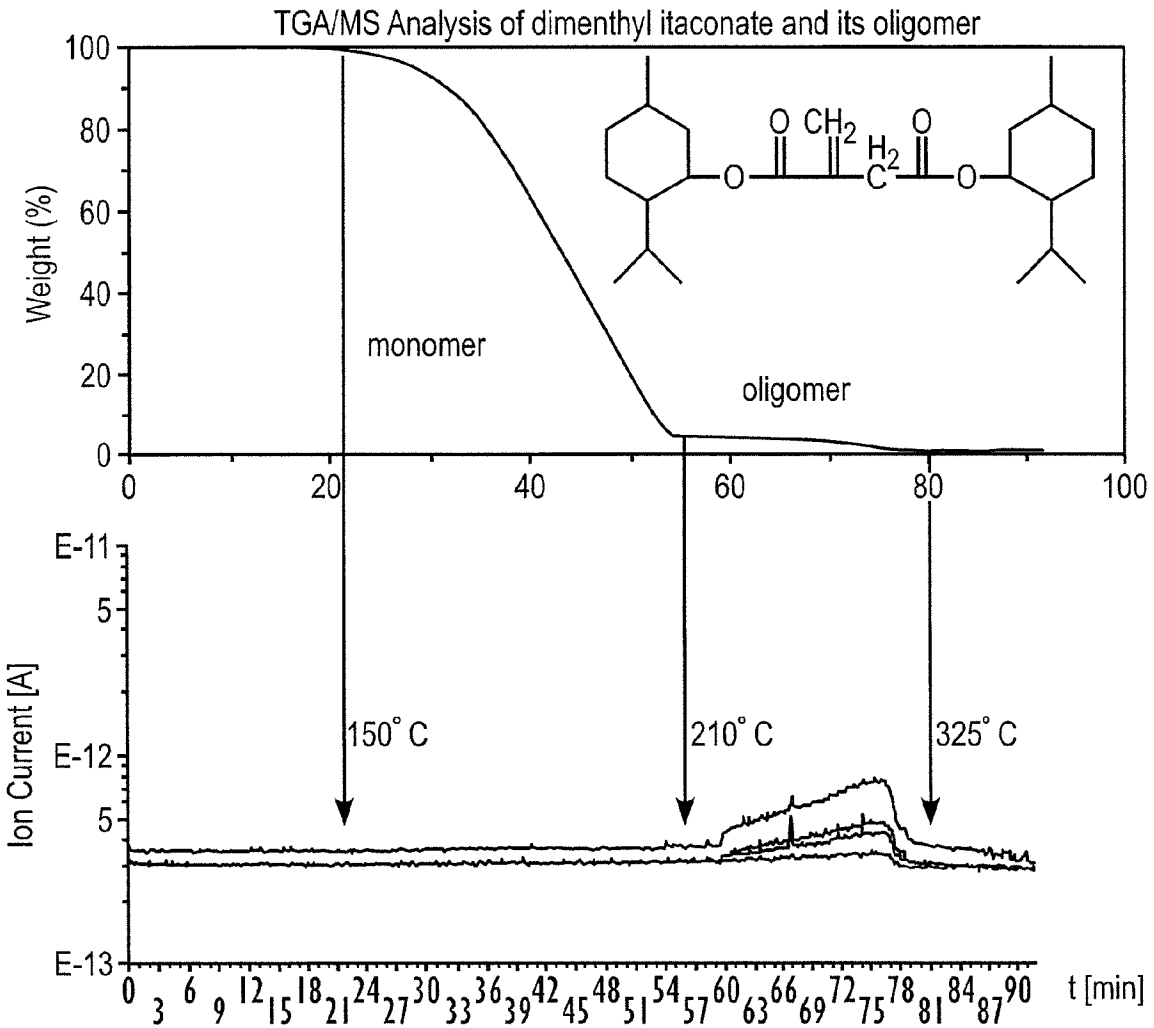

| | | | |
|---|---|---|---|
| 5,388,594 | A | 2/1995 | Counts et al. |
| 5,499,636 | A | 3/1996 | Baggett, Jr. et al. |
| 5,666,976 | A | 9/1997 | Adams et al. |
| 5,692,525 | A | 12/1997 | Counts et al. |
| 5,692,526 | A | 12/1997 | Adams et al. |
| 5,915,387 | A | 6/1999 | Baggett, Jr. et al. |
| 5,988,176 | A | 11/1999 | Baggett, Jr. et al. |
| 6,026,820 | A | 2/2000 | Baggett, Jr. et al. |
| 6,060,207 | A | 5/2000 | Shida et al. |
| 6,315,987 | B1 | 11/2001 | Plochocka |
| 6,464,961 | B2 | 10/2002 | Plochocka |
| 7,048,912 | B2 | 5/2006 | Plochocka |
| 7,144,938 | B1 | 12/2006 | Feinberg et al. |
| 2004/0253188 | A1* | 12/2004 | Plochocka ..... 424/49 |
| 2009/0028803 | A1 | 1/2009 | Mishra et al. |
| 2011/0083679 | A1 | 4/2011 | Liu et al. |

OTHER PUBLICATIONS

International Search Report and Written Opinion mailed Oct. 4, 2011 for PCT/IP2011/001167.

Cochin, D. et al. "*New Substituted Polymethylenes by Free Radical Polymerization of Bulky Fumarates and Their Properities*," Polymer 41, Elsevier Science Ltd. (2000) 3895-3903.

Oishi, T. et al. "Synthesis and Polymerization of Optically Active DI-L-Menthyl ltaconate," J. Macromol. Sci.-Chem., A26(12), pp. 1611-1621 Marcel Dekker, Inc. (1989).

* cited by examiner

SMOKING ARTICLES CONTAINING POLYMERS OF POLYCARBOXYLIC ACID ESTERS

CROSS REFERENCE TO RELATED APPLICATION

This application claims priority under 35 U.S.C. §119(e) to U.S. Provisional Application No. 61/318,205, filed on Mar. 26, 2010, the entire content of which is incorporated herein by reference thereto.

SUMMARY

There is interest in providing flavorants and/or chemesthetic agents, such as menthol in smoking articles, wherein the migration and loss of flavorants or chemesthetic agents is reduced.

In one embodiment is provided a smoking article containing a rod containing a smokable composition, an optional wrapper for the rod, and at least one polymer or oligomer comprising monomer units of a polycarboxylic acid ester disposed on or in the rod, the wrapper, or both. The polycarboxylic acid ester contains an acid moiety having at least two carboxylic groups, and at least two alcohol moieties which can be the same or different, and are independently selected from those corresponding to a cycloalkyl alcohol or an aryl alcohol. The cycloalkyl alcohol or aryl alcohol is a flavorant, or chemesthetic agent, or both.

In another embodiment is provided a method for controlling the release of flavorant or chemesthetic agent comprising a cycloalkyl alcohol or aryl alcohol, comprising pyrolyzing at least one polymer or oligomer comprising monomer units of a polycarboxylic acid ester, wherein said polycarboxylic acid ester comprises an acid moiety comprising at least two carboxylic groups, and at least two alcohol moieties independently selected from those corresponding to a cycloalkyl alcohol or an aryl alcohol.

BRIEF DESCRIPTION OF THE DRAWING FIGURES

FIG. 1 is a graph showing a thermogravimetric analysis (TGA)/mass spectroscopy (MS) plot of a mixture of dimenthyl itaconate monomer and oligomer thereof. FIG. 1*a* is a thermogram generated by TGA; FIG. 1*b* is a real-time spectrum generated by MS.

DETAILED DESCRIPTION

The present application describes smoking articles containing at least one polymer or oligomer having monomer units of a polycarboxylic acid ester containing one or more flavorants and/or chemesthetic agents covalently bonded to the polycarboxylic acid as the esterifying alcohol moieties of the polycarboxylic acid ester. These alcohol moieties are released during or following pyrolysis of at least a portion of the polymer or oligomer and, upon release, function as a flavorant or chemesthetic agent during smoking.

As used herein, the term "smoking article" denotes an article containing a charge of smoking composition formed into a rod or column, and which may optionally be surrounded by a wrapper, which helps to hold the shape of the rod and contain the smoking composition within the smoking article. The rod of smoking material, or the wrapper therefor, or both can be burned or heated during use of the smoking article under smoking conditions. A smoking article may also contain one or more filters, which can function to remove targeted constituents from, and provide aesthetically pleasing qualities to, the smoke. The term "smoking article" is intended to include cigarettes, which include both traditional cigarettes and electrically heated cigarettes, as well as cigarettes having a fuel element in the tobacco rod.

As used herein, the term "traditional cigarette" denotes a cigarette that can be smoked by lighting an end of a wrapped rod or column of a smoking composition and drawing air predominantly through the lit end by suction at the mouthpiece end of the cigarette. Traditional cigarettes can deliver smoke as a result of combustion of the smoking composition, at temperatures that typically exceed about 800° C. during a puff. Combustion can release constituents that are drawn through the cigarette, and combustion products can cool and condense to form aerosols. These aerosols can provide some of the flavors and aromas associated with smoking. Traditional cigarettes often contain a filter element, typically composed of one or more pieces of filter material wrapped by a wrapper known as a plug wrap, which can typically be attached to one end of the rod of shredded smoking composition (e.g., tobacco, also referred to as a "tobacco rod") by means of a wrapping or tipping material.

As used herein, the term "electrically heated cigarette" denotes an alternative to the traditional cigarette used in electrical smoking systems. Electrical smoking systems can generally include an electrically powered lighter and an electrically heated cigarette, which can be constructed to cooperate with the lighter, and which generally contains a rod or column of smoking composition. Electrical smoking systems generate only small amounts of sidestream smoke, and also permit consumers to suspend and reinitiate smoking as desired. Exemplary electrical smoking systems are described in U.S. Pat. Nos. 6,026,820; 5,988,176; 5,915,387; 5,692,526; 5,692,525; 5,666,976; 5,499,636; and 5,388,594, the contents of which are incorporated herein by reference. It is desirable that electrical smoking systems be capable of delivering smoke in a manner similar to the consumer's experiences with traditional cigarettes, such as by providing an immediate response (smoke delivery occurring immediately upon draw), a desired level of delivery (that correlates with FTC tar level), a desired resistance to draw (RTD), as well as puff-to-puff and cigarette-to-cigarette consistency.

As used herein, the term "cigarettes having a fuel element in the tobacco rod" denotes any type of cigarette having such a fuel element in or adjacent to the tobacco rod. Exemplary cigarettes of this type are described in U.S. Pat. No. 4,966,171, the contents of which are incorporated herein by reference.

As used herein, the term "smokable composition" denotes any material that is intended to be combusted or heated, generating smoke or vapor which is ingested by the user. The term is intended to include tobacco (i.e., cut filler, tobacco powder, etc.), tobacco substitute materials (i.e., vegetable or plant products like shredded lettuce) or a mixture of both. Specific examples of smoking compositions may include, but are not limited to, flue-cured tobacco, Burley tobacco, Maryland tobacco, Oriental tobacco, rare tobacco, specialty tobacco, reconstituted tobacco, genetically modified tobacco, and blends thereof. Smoking compositions can include these materials in any suitable form, including, but not limited to: lamina, such as tobacco lamina; processed materials, such as volume expanded or puffed tobacco; ground materials, such as ground tobacco; processed stems, such as cut-rolled or cut-puffed tobacco stems, reconstituted material, such as reconstituted tobacco; and blends thereof.

As used herein, the term "wrapper" denotes a sheet of material, more particularly a combustible, cellulosic material, even more particularly a paper, that is or can be made to be sufficiently flexible to wrap around and contain a rod or column of smoking composition. The term is intended to include papers suitable for wrapping, or used to wrap, traditional cigarettes, as well as wrappers suitable for wrapping, or used to wrap, electrically heated cigarettes.

As used herein, the term "flavorant" denotes one or more compounds that are perceived by taste receptor or olfactory sensory cells of a consumer, but includes compounds that are perceived by additional senses as well. Suitable flavorants include cycloalkyl alcohols and aryl alcohols, such as menthol, thymol, and eugenol.

As used herein, the term "chemesthetic agent" denotes one or more compounds that are perceived in the oral or olfactory cavities by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, soothing sensations. Some compounds have both a flavorant and chemesthetic effect. For example, menthol provides a minty flavorant effect, but also provides a cooling chemesthetic effect, and can appropriately be categorized herein as both a flavorant and a chemesthetic agent.

As used herein, the term "polymer" denotes a covalently bonded chain of monomer units, and is intended to include both homopolymers and copolymers.

As used herein, the term "oligomer" denotes a covalently bonded chain of monomer units that has fewer monomer units than a polymer, and may typically have 2 to 4 monomer units. An oligomer containing one single type of monomer is termed herein a "homo-oligomer." An oligomer containing more than one type of monomer is termed herein a "co-oligomer."

As used herein, the term "monomer" denotes the chemical species that react to form a polymer or oligomer. Once the polymer or oligomer has formed, e.g., as the result of free radical polymerization or oligomerization, the subunits of the polymer or oligomer corresponding to the monomer or monomers are termed herein "monomer units." For example, free radical polymerization or oligomerization of the monomers itaconic acid, maleic acid, or fumaric acid, would yield a polymer or oligomer containing the monomer units 1-carboxy-1-carboxymethylethylene (from itaconic acid), or 1,2-dicarboxyethylene (from maleic or fumaric acid).

It will be understood that the unsaturated bonds in the monomer react during free radical polymerization or oligomerization to form the monomer units of the polymer chain. The result of this reaction is that the bond becomes saturated, so that, e.g., a double bond becomes a single bond. Thus, an unsaturated acid or ester monomer can be polymerized to give a polymer or oligomer containing the corresponding saturated monomer unit.

As used herein, the term "polycarboxylic acid" denotes acyclic or cyclic polycarboxylic acids containing more than one carboxy group. Particularly suitable polycarboxylic acids include unsaturated polycarboxylic acids, i.e., those polycarboxylic acids that contain one or more unsaturated bonds between carbon atoms. Particularly suitable unsaturated polycarboxylic acids include unsaturated, acyclic dicarboxylic acids, such as itaconic acid, maleic acid, and fumaric acid.

As used herein, the term "diester" denotes a compound formed by esterifying two carboxyl moieties of a polycarboxylic acid with alcohol moieties. It is intended to include compounds where both of the esterifying alcohol moieties are the same as, or different from, each other. Particularly suitable diesters include diesters of dicarboxylic acids, i.e., diesters where the acid moiety contains two carboxylic groups. Diesters of dicarboxylic acids that are particularly suitable for use herein include compounds where both carboxy moieties are esterified by the same or different cycloalkyl alcohol moieties, compounds where both carboxy moieties are esterified with the same or different aryl alcohol moieties, and compounds where one carboxy moiety is esterified by a cycloalkyl alcohol moiety and another is esterified with an aryl alcohol moiety.

As used herein, the term "cycloalkyl alcohol" denotes alcohol-containing compounds having a cyclic alkyl moiety therein, such as a cyclohexyl group, whether or not that cyclic alkyl moiety is further substituted by other substituents, and whether or not the cyclic alkyl moiety is directly bonded to a hydroxyl group, or is bonded to a hydroxyl group through another moiety, such as an alkyl group. It is particularly intended to include alcohol compounds having cyclic alkyl moieties that are substituted with lower alkyl or lower alkenyl groups, such as a cyclohexyl moiety that is substituted with methyl and/or isopropyl groups, such as menthol.

As used herein, the term "aryl alcohol" denotes an alcohol-containing compound having an aryl moiety therein, such as a phenyl group, whether or not that aryl moiety is further substituted by other substituents, and whether or not the aryl moiety is directly bonded to a hydroxyl moiety. It is particularly intended to include compounds having aryl moieties that are substituted with lower alkyl, lower alkoxy, and/or lower alkenyl groups, such as thymol and eugenol.

As used herein, the terms "lower alkyl" and "lower alkoxy" denote alkyl and alkoxy moieties having 1 to about 7 carbon atoms, respectively and "lower alkenyl" denotes alkenyl moieties having 2 to about 7 carbon atoms.

As used herein, the term "menthol" denotes any menthol moiety regardless of the stereochemistry at the asymmetric carbon atoms in the molecule. That is, "menthol" may include any stereoisomer or a mixture thereof, including racemic mixtures.

As used herein, the term "about" can be reasonably appreciated by a person skilled in the art to denote somewhat above or below the stated numerical value, to within a range of ±10%.

As used herein, the term "pyrolysis" denotes the degradation of a chemical compound resulting from exposure to a high temperature, e.g., by heating, combustion, or both. It is particularly intended to include the heat induced splitting of carboxylic ester linkages to yield the corresponding alcohol and anhydride moieties, and particularly such splitting occurring under conditions encountered when a smoking article is smoked by a consumer.

The oligomers or polymers described herein contain monomer units that contain esters of polycarboxylic acids; i.e., the monomer unit contains an acid moiety having more than one carboxylic acid group. At least two of the carboxylic acid groups of each monomer unit have been esterified by the cycloalkyl alcohol or aryl alcohol flavorant/chemesthetic agents described herein; if more than two carboxylic acid groups are present, the excess number may be esterified or unesterified. Preferably the esters of polycarboxylic acids are diesters of polycarboxylic acids, even more preferably diesters of dicarboxylic acids. Preferred cycloalkyl alcohol moieties include a menthol moiety; preferred aryl alcohol moieties include thymol and eugenol alcohol moieties. The alcohol moieties of a single monomer unit may be the same or different; the alcohol moieties of different monomer units in the same polymer or oligomer may be the same or different. The polycarboxylic acid moieties may also differ between monomer units of the same polymer or oligomer.

The polymers or oligomers described herein may also be copolymers and co-oligomers formed by reacting monomers comprising one or more of the polycarboxylic acid esters described above with other co-monomers, in particular, with other unsaturated co-monomers. In particular, suitable co-monomers can include: unsaturated carboxylic acids or esters, such as acrylic acid, methacrylic acid, methyl acrylate, methyl methacrylate; vinyl compounds; and similar polymerizable unsaturated compounds.

In the polymers and oligomers described herein, the cycloalkyl alcohol or aryl alcohol moieties are covalently bound to the polymer chain through the carboxylate group, i.e., through a non-carbonate linking group. This tends to immobilize these moieties, significantly decreasing their ability to migrate or volatilize prior to reaching a release temperature, where pyrolysis of the polymer results in release of cyclic alcohol and/or aryl alcohol flavorants or chemesthetic agents. The release temperature is typically sufficiently above the temperatures encountered during the manufacture and/or storage of smoking articles that there is little, if any, release of the cycloalkyl or aryl alcohol during manufacture or storage of smoking articles containing the polymers or oligomers described herein. As a result, loss of flavorant or chemesthetic agent can be reduced during handling and storage of smoking articles.

Under smoking conditions, the polymers and oligomers described herein release flavorant or chemesthetic agents, such as menthol, thymol, and/or eugenol, upon pyrolysis of the polymers or oligomers described herein. Typically, when air is being drawn by puffing through a smoking article, such as a traditional cigarette, the temperature of the burning zone may reach up to about 880° C., and when the cigarette is smoldering (burned without air being drawn through it by the smoker), the temperature may reach up to about 840° C. Further, in an electrically heated cigarette, the heating temperature may reach up to 900° C. These temperatures are sufficiently high that the polymers and oligomers described herein will undergo pyrolysis.

For example, it has been found that menthol release by pyrolysis can be expected to occur well below the high temperatures of a burning or smoldering cigarette (e.g., as low as around 210° C. to 325° C.). As a result, the polymers and oligomers described herein can be used as heat activated flavorant or chemesthetic release agents in smoking articles, such as traditional cigarettes and electrically heated cigarettes.

Specific examples of particularly suitable oligomers and polymers of dimenthyl esters of dicarboxylic acids may include, but are not limited to, homo-oligomers, co-oligomers, homopolymers and/or copolymers that contain monomer units of one or more of dimenthyl itaconate, dimenthyl maleate and dimenthyl fumarate. The resulting oligomers or polymers may be used individually or in combination thereof, e.g., polymer or oligomer blends.

The polymers and oligomers of dimenthyl dicarboxylic acid esters described herein can be prepared by free radical polymerization of a dimenthyl dicarboxylate ester. Any appropriate free radical initiator may be used. The radical initiator may be used in an amount in the range from about 0.01 wt % to about 20 wt %, and preferably about 2 wt %, based on the total weight of monomers to be polymerized.

Examples of suitable radical initiators may include, but are not limited to, peroxide compounds such as dicumyl peroxide and/or benzoyl peroxide. Other suitable initiators include azo compounds, such as 1,1'-azobis(cyclohexanecarbonitrile) (ABCN), 2,2'-azobis(2-methylpropionamidine)dihydrochloride, 2,2'-azobis(2-methylpropionitrile) (i.e., azobisisobutyronitrile or AIBN), and/or 4,4'-azobis(4-cyanovaleric acid).

Alternatively, redox initiation systems, such as ammonium persulfate, potassium persulfate, sodium persulfate, and similar systems, may also be used.

Preferably, the radical initiator includes azobisisobutyronitrile (AIBN).

The radical polymerization may be carried out in the absence of solvent, or in the presence of an inert solvent which does not participate in or interfere with the polymerization process. Examples of suitable solvents for free radical polymerization may include, but are not limited to, aromatics such as toluene, xylene; ethers such as tetrahydrofuran, ethylene glycol monobutyl ether, ethylene glycol monoethyl ether; aliphatic alcohols such as ethyl alcohol, isopropyl alcohol and the like; carboxylic acids such as acetic acid; and water. These solvents may be used individually or in combination. Preferably, the polymerizatoin is carried out in the absence of solvent, or in a solvent that includes toluene.

The free radical polymerization process may be carried out in any appropriate manner and under any appropriate conditions. The polymerizations, in particular the polymerization temperature and time period, may vary depending on, for example, types, amounts, and/or concentration of monomers, free radical initiator and solvent (if any) to be used. Typically, the free radical polymerization can be carried out at a temperature from about 25° C. to about 150° C. and preferably, from about 80° C. to about 90° C., and for a time period ranging from about 10 minutes to about 48 hours and preferably, about 2 hours.

In addition to monomers that are diesters of cycloalkyl alcohols and/or aryl alcohols and unsaturated polycarboxylic acids, one or more co-monomers may also be used during polymerization to prepare copolymers or co-oligomers. Typically, these co-monomers will not be diesters of cycloalkyl alcohols or aryl alcohols and unsaturated polycarboxylic acids. Examples of suitable co-monomers may include, but are not limited to, unsaturated acids and esters thereof, such as acrylic acid (AA), methacrylic acid, methyl acrylate, methyl methacrylate, monomethyl itaconate, monomenthyl itaconate, 2-hydroxyethyl methacrylate; vinyl compounds, such as styrene, 4-vinyl pyridine, bis(4-(vinyloxy)butyl) adipate, 4-(vinyloxy)butyl stearate; and similar polymerizable unsaturated monomers. These co-monomers may be used individually or in combination. The concentration of co-monomers in the copolymers and co-oligomers may range from about 0.1 wt % to about 99.9 wt %.

The polymers and oligomers of diesters of the polycarboxylic acid esters described herein can be applied in any suitable form, such as a solid powder, or as a solution or suspension in an appropriate solvent. The amount of a polymer or oligomer applied may vary, and may in part depend on the type and molecular weight of the polymer, as well as the amount of menthyl groups bonded to the oligomer or polymer. As an example, dimenthyl itaconate oligomer may be incorporated in cigarettes (e.g., by introducing it into the tobacco rod) in an amount between about 30 mg to 100 mg of oligomer per cigarette, either as a powder or as a solution in a solvent (e.g., acetone), by blending the powder or solution with the materials forming the tobacco rod during preparation of the smoking composition, by dipping or spraying or dipping a solution or suspension of polymer or oligomer onto the smoking composition, etc. If added as a solution in a solvent, the solvent may be subsequently removed during subsequent processing.

The oligomers and polymers described herein can also be incorporated into the paper wrapper for the tobacco rod, again by mixing, spraying, or dipping, to further enhance side-stream smoke flavor and aroma under smoking conditions. Alternatively, the polymers and oligomers of may be printed in a pattern on the wrapper. This technique of application may be particularly desirable when the smoking article is an electrically heated cigarette.

In one embodiment, a smokeless tobacco composition is provided which comprises a mixture of tobacco or tobacco substitute and the flavorant-containing polymer described herein.

The flavorant-containing polymers can be incorporated into a variety of products. In an embodiment, a flavorant-containing polymer can be used in a comestible, preferably in an amount of about 0.0001-10% by weight based on the amount of the comestible. In a further embodiment, the flavorant-containing polymer includes a polymer wherein the flavorant is linked to the polymeric backbone through a non-carbonate linking group. The flavorant-containing polymer may be added at any point in the process of making the comestible to be treated. Preferably, after the addition of the flavorant-containing polymer, the mixture is not subsequently subject to conditions, such as high temperatures and wet conditions, that might cause release of the flavorant during manufacture. Release of the flavorant can be accomplished by mastication, hydrolysis, swelling or a mixture of non-pyrolytic release mechanisms. In another embodiment, release of the flavorant can be accomplished by heating, such as release of mint or other flavor in a hot chocolate, cocoa, coffee or tea drink. In these embodiments, it would be possible to make, for example, a mint-flavored chocolate which does not flavor other mint-less chocolates with which it is packaged.

The flavorant-containing polymer may be incorporated into a smokeless tobacco composition in a variety of ways. For example, the flavorant-containing polymer can be dissolved in an appropriate solvent and sprayed upon a tobacco or tobacco substitute. The flavorant-containing polymer may also be suspended in a liquid such as water or alcohol and applied to a tobacco or tobacco substitute, for example, for spraying, dipping or dropping. Further, the flavorant-containing polymer may be added as a powder or processed unit to a tobacco or tobacco substitute. Release of the flavorant can be accomplished by mastication, hydrolysis, swelling or a combination of non-pyrolytic release mechanisms. In this embodiment, it would be possible using these flavorant-containing polymers to produce, for example, a container enclosing multiple flavors of snuff, where each flavor is unaffected by the other flavors in the container.

In another embodiment, the flavorant-containing polymer may be incorporated into heatable or combustible products. In this embodiment, pleasant fragrances can be released into the local atmosphere when the products are heated or burned. For example, by incorporating about 0.0001 to 10% by weight of the flavorant-containing polymer into an otherwise unscented candle, a candle can be produced which has little or no discernable fragrance before lighting, but releases a fragrance upon combustion. A flavorant-containing polymer may also be incorporated into other products including fragrance sticks, incense, room deodorizers, artificial or treated fireplace logs and other products which are heated or combusted in a domestic or other environment for aesthetic reasons.

The non-limiting examples provided below further explain and illustrate the the oligomers and polymers described herein.

EXAMPLE 1

Homo-Oligomerization of Dimenthyl Itaconate (DMI)

DMI (5.00 g, prepared according to *Journal of Macromolecular science-Chemistry,* A26 (12), 1611-21, 1989) and azobisisobutyronitrile (AIBN) (0.05 g) (as a free radical initiator) are charged to a round bottom Schlenk flask equipped with a magnetic stirring bar. After two cycles of "freeze-pump-thaw" (to remove oxygen), the flask was filled with nitrogen and then put into an oil bath at 90° C. The reaction was terminated after 1 hour. The crude product was dissolved in tetrahydrofuran (THF), and then precipitated in pentane. The product was filtered and dried under vacuum to provide 0.23 g of homopoly(dimenthyl itaconate) (conversion: 4.6%).

EXAMPLE 2

Copolymerization of Dimenthyl Itaconate (DMI) and Acrylic Acid (AA)

8.0 g of DMI (19.7 mmol), 1.42 g of AA (19.7 mmol) and 0.2 g of azobisisobutyronitrile (AIBN) as a free radical initiator were added to toluene (12 mL) in a round bottom Schlenk flask equipped with a magnetic stirring bar. After two cycles of "freeze-pump-thaw" (to remove oxygen), the flask was filled with nitrogen and the mixture was heated at 90° C. for 2 hours. Thereafter, the solvent was removed with a rotary evaporator. The white solid residue was dissolved in acetone, and then precipitated by adding hexanes. The precipitated solid substance was separated from the liquid phase and then dried in vacuum, thereby affording 1.98 g of a copolymer of DMI and AA (conversion: 21.0%). $^1$H NMR indicated that the DMI was incorporated in the copolymer in an amount of about 23.3 mol %, with the remainder being AA.

FIG. 1 shows the results of weight loss and menthol release studies of a mixture of dimenthyl itaconate monomer and a dimenthyl itaconate homo-oligomer as a function of temperature.

FIG. 1*a* is a thermogram generated by TGA of a mixture of dimenthyl itaconate monomer and a dimenthyl itaconate oligomer. The Y axis represents the weight of the mixture remaining (as a percentage of the original weight of the mixture) and the X axis represents time in minutes. A rapid drop in the weight of the sample is observed between about 22 and about 55 minutes (corresponding to temperatures between about 150° C. and about 210° C.) in the thermogram. This indicates that at temperatures between about 150° C. and about 210° C., dimenthyl itaconate monomer is distilling out from the mixture without releasing menthol; this accounts for the significant weight loss of the mixture over this temperature range. A more gradual decrease in weight is observed between about 55 and about 78 minutes, corresponding to temperatures between about 210° C. and about 325° C. This decrease is attributable to pyrolysis of the dimenthyl itaconate oligomer over this temperature range, which results in the release of menthol.

FIG. 1*b* is a real-time spectrum from a mass spectrographic analysis of the same mixture. The Y axis represents ion current intensity in amperes for menthol molecules and the X axis represents time in minutes. The results shown in FIG. 1*b* confirm the analysis presented above with respect to FIG. 1*a*.

The mass spectrum (FIG. 1*b*) shows an increasing trend line for menthol between about 60 minutes and about 80 minutes, which corresponds to temperatures falling within the 210° C. to 325° C. range described above. This confirms that menthol release by pyrolysis of the oligomer occurs between the temperature range of about 210° C. to about 325° C.; however, MS peaks indicating menthol release from the mixture were not observed in the temperature range of about 150° C. to about 210° C.

Similar behavior is expected for other polymers and oligomers described herein containing monomer units comprising cycloalkyl or aryl esters of polycarboxylic acids.

Although not wishing to be bound by any theory, it is believed that the flavorant or chemesthetic agent release temperature of these polymers or oligomers may depend somewhat upon the molecular weight of the polymer or oligomer. In general, higher molecular weight polymers and oligomers have higher release temperatures for the cycloalkyl alcohol and aryl alcohol flavorants or chemesthetic agents described herein. For example, it is to be generally expected that dimenthyl dicarboxylic acid ester homo- and co-polymers will begin to release menthol at temperatures higher than the release temperatures of the corresponding homo- and co-oligomers. However, it is also to be generally expected that these temperatures will be well below the temperatures existing in cigarettes under smoking conditions, so that menthol release during smoking conditions will occur with homo- and co-polymers as well.

While various embodiments have been described with reference to specific embodiments, variations and modifications may be made without departing from the spirit and the scope of the invention. Such variations and modifications are to be considered within the purview and scope of the invention as defined by the appended claims.

All of the above-mentioned references are herein incorporated by reference in their entirety to the same extent as if each individual reference was specifically and individually indicated to be incorporated herein by reference in its entirety.

What is claimed is:

1. A smoking article comprising:

a rod comprising a smokable composition;

an optional wrapper for the rod; and at least one polymer or oligomer comprising monomer units of a polycarboxylic acid ester disposed on or in the rod, the optional wrapper, or both;

wherein said polycarboxylic acid ester comprises an acid moiety comprising at least two carboxylic groups, and at least two alcohol moieties, which may be the same or different, and are independently selected from those corresponding to a cycloalkyl alcohol or an aryl alcohol, and wherein said cycloalkyl alcohol or aryl alcohol is a flavorant, or chemesthetic agent, or both.

2. The smoking article of claim 1, wherein said monomer units comprise one or more diesters of one or more dicarboxylic acids.

3. The smoking article of claim 1, wherein said at least one polymer or oligomer is dispersed in said smokable composition in said rod.

4. The smoking article of claim 1, wherein said at least one polymer or oligomer is dispersed in, or printed on, said wrapper for the rod.

5. The smoking article of claim 1, further comprising a filter, and wherein said at least one polymer or oligomer is dispersed in said filter.

6. The smoking article of claim 1, wherein said cycloalkyl alcohol or aryl alcohol comprise one or more of menthol, thymol, or eugenol.

7. The smoking article of claim 2, wherein said acid moiety comprises one or more selected from 1-carboxy-1-carboxymethylethylene, or 1,2-dicarboxyethylene.

8. The smoking article of claim 7, wherein said monomer units comprise those resulting from free radical polymerization or oligomerization of at least one of dimenthyl itaconate, dimenthyl maleate, or dimenthyl fumarate.

9. The smoking article of claim 8, wherein said monomer units comprise those resulting from radical polymerization or oligomerization of dimenthyl itaconate.

10. The smoking article of claim 1, wherein said at least one polymer or oligomer further comprises one or more monomer units different from said monomer units of said polycarboxylic acid ester, and resulting from free radical polymerization or oligomerization of one or more co-monomers.

11. The smoking article of claim 10, wherein said one or more co-monomers comprises an unsaturated carboxylic acid or ester.

12. The smoking article of claim 11, wherein said unsaturated carboxylic acid or ester comprises one or more of acrylic acid, methacrylic acid, methyl acrylate, or methyl methacrylate.

13. The smoking article according to claim 1, wherein the smoking article is a cigarette.

14. The smoking article of claim 13, wherein the cigarette is a traditional cigarette.

15. The smoking article of claim 13, wherein the cigarette is an electrically heated cigarette.

16. The smoking article of claim 13, wherein the cigarette comprises a fuel element in the tobacco rod.

17. The smoking article of claim 1, wherein the cycloalkyl alcohol or aryl alcohol are linked to the polymeric backbone through a non-carbonate linking group.

* * * * *